US007785509B2

(12) United States Patent
Perera et al.

(10) Patent No.: US 7,785,509 B2
(45) Date of Patent: Aug. 31, 2010

(54) EXPANSIBLE YARNS AND THREADS, AND PRODUCTS MADE USING THEM

(75) Inventors: Willorage Rathna Perera, Fall River, MA (US); Gerald J. Mauretti, Fall River, MA (US)

(73) Assignee: Pascale Industries, Inc., Pine Bluff, AR (US)

( * ) Notice: Subject to any disclaimer, the term of this patent is extended or adjusted under 35 U.S.C. 154(b) by 984 days.

(21) Appl. No.: 11/312,482

(22) Filed: Dec. 21, 2005

(65) Prior Publication Data

US 2007/0141335 A1 Jun. 21, 2007

(51) Int. Cl.
*B29C 67/00* (2006.01)

(52) U.S. Cl. ..... 264/136

(58) Field of Classification Search ..... 264/136
See application file for complete search history.

(56) References Cited

U.S. PATENT DOCUMENTS

| | | | | |
|---|---|---|---|---|
| 2,879,197 | A | 3/1959 | Muskat et al. | |
| 2,972,554 | A | 2/1961 | Muskat et al. | |
| 3,042,570 | A * | 7/1962 | Bradt | 264/171.13 |
| 3,072,512 | A | 1/1963 | Dalle | |
| 3,100,926 | A | 8/1963 | Richmond | |
| 3,451,696 | A | 6/1969 | Hagelin et al. | |
| 3,574,020 | A | 4/1971 | Wisotzky | |
| 3,646,749 | A | 3/1972 | Clough et al. | |
| 3,881,977 | A * | 5/1975 | Dauksys | 156/242 |
| 3,980,511 | A | 9/1976 | Proucelle | |
| 4,144,371 | A | 3/1979 | Okie et al. | |
| 4,197,345 | A | 4/1980 | Worrall | |
| 4,243,713 | A | 1/1981 | Worrall et al. | |
| 4,520,059 | A | 5/1985 | Worrall et al. | |
| 4,680,224 | A * | 7/1987 | O'Connor | 428/298.1 |
| 4,731,281 | A | 3/1988 | Fleischer et al. | |
| 5,019,427 | A * | 5/1991 | Soules | 427/375 |

(Continued)

FOREIGN PATENT DOCUMENTS

WO WO2005/052232 6/2005

OTHER PUBLICATIONS

"Expancel in Light Weight Foam", Technical Bulletin No. 25 (2003).

(Continued)

*Primary Examiner*—Joseph S Del Sole
*Assistant Examiner*—John P Robitaille
(74) *Attorney, Agent, or Firm*—Michael de Angeli

(57) ABSTRACT

A precursor yarn or thread is made by passing a central element, e.g., a filament, a tow, or a flat member, through a bath of a binder, such as a low-temperature hot-melt adhesive, and aqueous urethane, or an acrylic material, with which is mixed a quantity of hard-shelled microspheres which expand when heated to a higher temperature. This is then covered by a sheath, e.g, of PVC, polyurethane, polyester, acrylic resin, polycarbonate, polypropylene, or polyethylene in a second bath. When this product is heated to a transition temperature which is characteristic of the microspheres chosen, the microspheres expand, swelling the sheath. Such a precursor could be woven into a fabric and then heated, so that as the yarn expands the fabric mesh becomes tighter, reducing its porosity. This would be useful as a yarn in making papermaker's felts.

13 Claims, 3 Drawing Sheets

PASS MONO- OR MULTI-FILAMENT TOW, YARN, OR THREAD CENTRAL MEMBER THROUGH BATH OF ADHESIVE WITH EXPANSIBLE MICROSPHERES.

U.S. PATENT DOCUMENTS

| | | | | |
|---|---|---|---|---|
| 5,124,194 | A | 6/1992 | Kawano | |
| 5,204,150 | A | 4/1993 | Davenport | |
| 5,391,419 | A | 2/1995 | Davenport | |
| 5,562,985 | A * | 10/1996 | Sano et al. | 428/375 |
| 5,866,253 | A * | 2/1999 | Philipps et al. | 428/374 |
| 2004/0081774 | A1 * | 4/2004 | Notsu et al. | 428/32.6 |
| 2005/0064776 | A1 | 3/2005 | Sobonya et al. | |

OTHER PUBLICATIONS

"Expancel"—the product (undated).

"Expancel Microspheres in Technical Textiles and Nonwovens", Technical Bulletin No. 9 (2004).

"Expancel Microspheres in Thermoplastics", Technical Bulletin No. 24 (2004).

"The product" http://www.expancel.com.english/product/main.htm (2004).

"Expancel Preliminary Specification for Special Expancel Products" (2002).

Bercen, Inc. Berbond 8980 Technical Data Sheet(2005).

* cited by examiner

EXPANSIBLE YARNS AND THREADS, AND PRODUCTS MADE USING THEM

FIELD OF THE INVENTION

This invention relates to novel yarns and threads that can be expanded after being woven into fabric, or used to fabricate various useful products and thereafter expanded, so as to provide improved functionality. The invention also relates to various classes of products that can be made using these products.

BACKGROUND OF THE INVENTION

As above, the invention relates to novel yarns and threads (using these terms broadly, as explained further below) that can be expanded after being woven into fabric, or used to fabricate various useful products, and thereafter expanded. Such yarns and threads can be used to fabricate various novel and useful products.

For example, "papermaker's felts" are, generally, woven fabrics used to manufacture belts supporting a wood-fiber slurry in manufacture of paper. It is important to control the porosity of the woven fabric, as its porosity controls the rate at which water is removed in the drying process, which is a critical step in the papermaking process. The porosity of a papermaker's felt is largely related to the diameter of the "yarns" or threads from which it is woven, but this cannot be chosen independent of all other variables, such as the feasibility of weaving, the strength of the fabric, and so on. A yarn the diameter of which could be altered after weaving would be a very useful product, since it would expand the flexibility available in specification of the fabric; that is, the fabric could be woven and the yarns subsequently expanded to reduce the porosity of the fabric.

Similarly, in manufacture of many sorts of goods which are sewn together, such as tents, awnings, clothing, sails, shoes, and many other products, the sewing process involves the puncturing of many holes in a fabric or other material which desirably would be waterproof and (in many case) air-impermeable. A thread which could be expanded after fabrication of the product, sealing these holes, would be very useful.

Other uses for expansible yarns according to the invention are discussed below.

A search for prior art patents directed to the invention, as described more fully below, identified the following:

Muskat U.S. Pat. No. 2,879,197 shows a method for making a foamed resin pad in which a fibrous batt is impregnated with a foamable resin; the product produced is a pad, e.g., for mattresses or the like. At col. 7, lines 9-25 the application of covering materials is described. Muskat does not seem to suggest using the expanding qualities of the foam material as a positive step in forming a product. An earlier-filed Muskat patent, U.S. Pat. No. 2,972,554, is closely related.

Dalle U.S. Pat. No. 3,072,512 shows making a reinforced sheet material, for manufacture of food bags and the like, wherein PVC-coated and uncoated nylon threads are heat-welded to sheet PVC.

Richmond U.S. Pat. No. 3,100,926 shows forming fabric from thread comprising a thermoplastic and a blowing agent, and heat-treating the fabric to cause the blowing agent to cause the thermoplastic threads to expand, and simultaneously causing the thermoplastic threads to adhere to one another.

Hagelin U.S. Pat. No. 3,451,696 shows a method for sealing the joints of ducts. An expandible sealing member, comprising, e.g., neoprene rubber mixed with expanding and curing agents, is assembled into the joint along with a pyrotechnical agent. The latter is then ignited, to cause the rubber mixture to expand and cure.

Wisotzky U.S. Pat. No. 3,574,020 shows vinyl-coated fabrics, in particular for controlled embossing processes.

Clough U.S. Pat. No. 3,646,749 shows metallized fabrics.

Proucelle U.S. Pat. No. 3,980,511 shows manufacture of panels for sound insulation purposes. Glass fibers are impregnated with a thermoplastic including an expanding agent; this is then heated to expand the plastic. After cooling the material is elastic.

U.S. Pat. No. 4,144,371 to Okie and Worrall shows fabrics made of a thread comprising single or multi-filaments encapsulated with a plastisol, which comprises PVC mixed with a foaming agent. The fabric is heat-treated after weaving to cause the threads to expand and weld to one another.

U.S. Pat. No. 4,197,345 to Worrall shows fabrics woven of threads at least some of which are made as in the Okie and Worrall patent, to provide contrasting colors.

U.S. Pat. No. 4,243,713 to Worrall and Auger shows fabrics woven of threads which have first and second plastisol coatings of different colors, to produce variegated color effects upon expansion for the foaming agent.

U.S. Pat. No. 4,520,059 to Worrall and Tefft shows fabrics, in particular papermaker's felts, made from a synthetic yarn such as nylon which is covered with an ionomer resin.

U.S. Pat. No. 4,731,281 to Fleischer also shows a papermaker's felt, woven from encapsulated or coated monofilament yarns.

U.S. Pat. No. 5,124,194 to Kawano shows microfibers made from hot-melt adhesive, having an "island-in-sea" structure.

U.S. Pat. No. 5,204,150 to Davenport shows a coated multifilament yarn for use in weaving on-machine-seamable press fabrics. The core material of the yarn is a polyamide thermoplastic and the coating can be a urethane or acrylic, if a permanent coating is desired; other materials are given for temporary or semipermanent coatings. U.S. Pat. No. 5,391,419, also to Davenport, is closely related.

Finally, published patent application 2005/0064776 to Sobonya shows sheet material, for use as a shelf liner or the like, comprising a scrim in a foamable resin, e.g., a PVC plastisol.

SUMMARY OF THE INVENTION

A precursor yarn or thread is made by passing a central element, e.g., a filament, a tow, a spun yarn, or a flat member such as a multifilamentary ribbon, through a bath of a binder, such as a low-temperature hot-melt adhesive, or an aqueous or urethane binder, with which is mixed a quantity of "microspheres". The microspheres are hard, substantially spherical members of a thermoplastic filled with a material, e.g., a hydrocarbon, which expands when heated to a higher temperature. The central element, having thus been coated by the microspheres, is then covered by a sheath, e.g. of a thermoplastic, such as PVC, polyester, polyurethane, polypropylene, or others. The sheath can be applied in a second bath, or by extrusion. When this precursor product is heated to a "transition temperature" which is characteristic of the microspheres chosen, the microspheres expand, swelling the sheath; the product remains expanded after cooling, such that the precursor is permanently expanded to a substantially larger final size.

Many uses are apparent for expansible yarns and threads, and other similar products, made according to the invention. A precursor yarn or ribbon could be woven into a fabric and then heated, so that as the yarn expands the fabric mesh becomes tighter, reducing its porosity. This would be useful as a yarn in making papermaker's felts. Heat-expansible threads made similarly would be useful in manufacture of shoes, sails, tents, clothing and other items where porosity is undesirable; that is, the product could be sewn together using the thread of the invention and then heat-treated, causing the thread to expand, sealing the holes made in sewing. Such threads would also be useful for decorative purposes, e.g., as embroidery yarns, and likely for other purposes.

Expansible yarns produced according to the invention can also be employed in fabrication of rigid composite products, where the expansible nature of the yarns are used to dispose high-strength materials in a desired pattern in the body of the product being manufactured, and a hardening resin used to retain them in the desired pattern. For example, yarns can be made according to the invention using high-strength central members, e,g., a carbon-fiber tow of a large number of fine filaments. A fabric could be woven of the yarns of the invention, and disposed in a mold, or a number of such yarns disposed in a desired pattern over a mandrel in a filament winding process. In either case, the yarns or fabric can be saturated with a curing resin, and heat treated to cause the yarns to expand; the resultant product would have the central members effectively spaced from one another through the cured matrix. This might be an efficient way of disposing a relatively small number of high-strength tensile members throughout a product of substantial cross-sectional dimension. Such a product would have high strength for its weight. The yarns of the invention could be similarly employed in other known processes, e.g., braiding, knitting, and in "laying-up" of non-woven scrims and the like.

BRIEF DESCRIPTION OF THE DRAWINGS

The invention will be better understood if reference is made to the accompanying drawings, in which.

DESCRIPTION OF THE PREFERRED EMBODIMENTS

As noted briefly above, the invention comprises the method of forming a precursor yarn or thread which can then be heat-treated to cause it to expand, as well as the yarns thus formed, processes for using the yarns, and the products manufactured thereby. The precursor yarn or thread is made by passing a central filamentary member through a first bath comprising a quantity of microspheres in an adhesive binder, so that the central member is coated by the microspheres. The coated central member thus formed is then sheathed by a thermoplastic layer, which can be added in a second bath, or in an extrusion step. This precursor yarn or thread can then be woven into a fabric, used to sew fabrics together, or put to any of a number of further uses, and can then be expanded, modifying the properties of the product in various useful ways.

The terms "yarn" and "thread" are being used herein, as generally in the art, to indicate larger or smaller filamentary products, respectively; the invention is not to be limited thereby. For example, "tow" is generally used to refer to a bundle of fibers, and this is considered within "yarn" herein. Similarly, a flat mono- or multi-filamentary ribbon is considered to be within "yarn" herein. Furthermore, a wide variety of filamentary members could be employed as the central member (that is, the member which is subsequently coated by expansible microspheres) depending on the properties needed in the final product, including spun, staple-spun, and continuous filamentary products.

Figure 1:
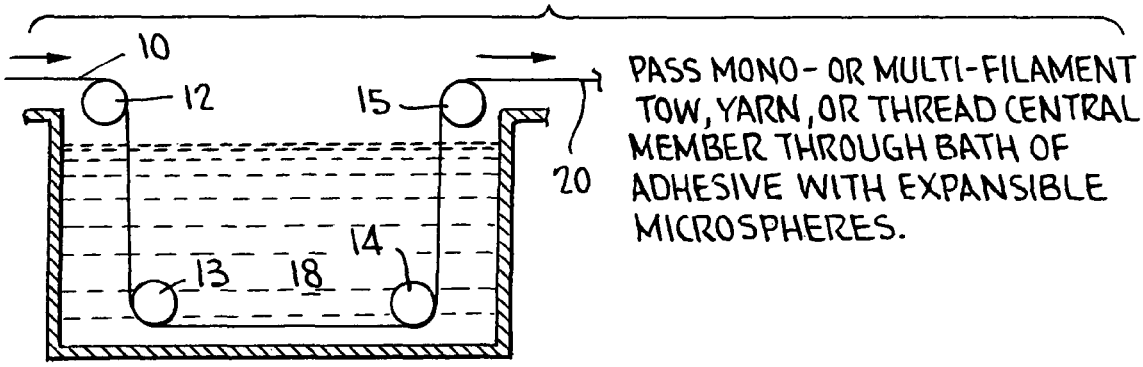
FIG. 1 shows schematically a first step in the process of making an expansible yarn or thread according to the invention, that is, coating a central filamentary member with expansible microspheres in a bath.
Figure 2:
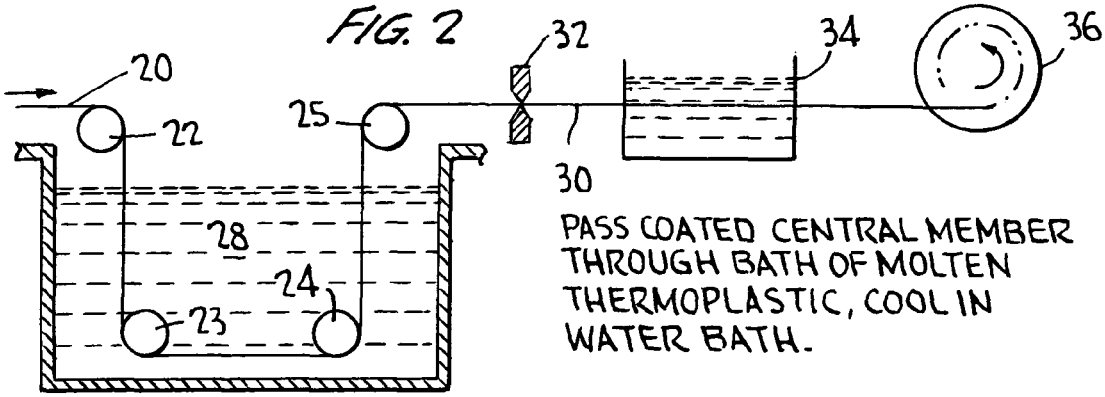
FIG. 2 shows schematically an optional second step in the process of making an expansible yarn or thread according to the invention, that is, encasing the coated central filamentary member with a thermoplastic layer in a bath.
Figure 3:
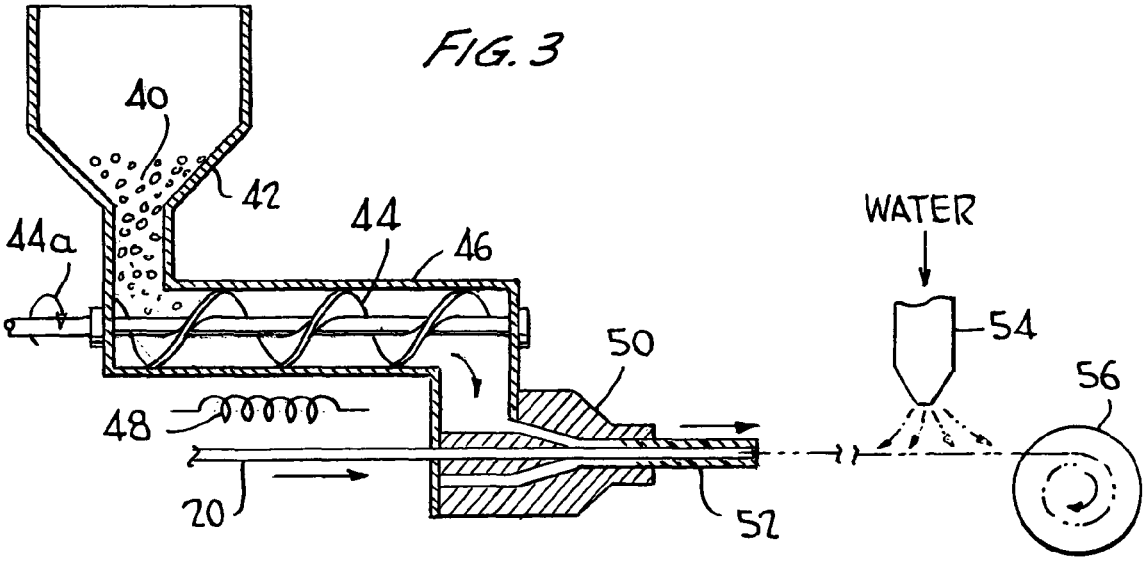
FIG. 3 shows schematically an alternative process for application of the outer sheath, by extrusion.

FIGS. 1 and 2 show schematically one possible sequence of steps to be employed in forming the precursor; FIG. 3 shows an alternative to FIG. 2. Initially, a mono- or multi-filamentary central member 10 is selected; structurally, this might be any of the classes of members referred to the art as tow, yarn, ribbon, or thread, or others. As mentioned, the central member 10 might be formed of one or more of a wide variety of spun and filamentary materials, including (by way of example only) polyesters, nylons, high tensile strength fibers if needed in the ultimate product, such as glass, carbon, or ceramic filaments, Kevlar, metal or plastic wires, conductive and nonconductive materials, and blends or mixtures of these and other materials as needed to fine-tune the product characteristics.

As illustrated in FIG. 1, the central member is passed, via a series of rollers 12-15, through a first bath 18 comprising a liquid binder containing a desired quantity of microspheres. The process can be repeated as desired to build up the thickness of the layer thus applied; typically a layer 5 mils thick is applied in each iteration of the process. Various suitable binders will occur to those of skill in the art; one that has been successfully tried is a water-based binder sold as Berbond 8980 from Bercen, Inc., which is described as a ethylene acrylic acid copolymer thermoplastic binder. This can be prepared in a solution of 25% by weight of the solid material in water at room temperature.

The microspheres to be used must also be carefully selected. Typically on the order of 10% by weight of the microsphere material is added to the binder. One group of useful products are available from the Expancel division of Akzo Nobel as Expancel DU, and are described as hollow spherical shells of thermoplastic copolymer material containing a hydrocarbon gas, e.g., isobutane or isopentane. When the microspheres are heated, the gas expands, and the thermoplastic shell softens, so that the shell is expanded; when the heat is removed, and the microsphere is allowed to cool, the thermoplastic shell retains its expanded size, and is essentially rigid. This is in distinction to the expanding foams employed in the prior art discussed above, which essentially form gas bubbles; such structures are much less stable than the expanded microspheres.

Expancel provides a "Technical Bulletin No. 9", which discusses application of microspheres to textiles and nonwovens by passing the fabric through a bath containing the microspheres, and coating the whole, not using the microspheres as a component of a thread or yarn, as according to the present invention.

It is desired to securely bind the microspheres to the central filamentary member 20, to avoid the microspheres from becoming detached during fabrication of products made using the yarn or thread of the invention. One way to do so is by application of a sheath over the microsphere-coated filamentary member; the sheath should be of a material that also expands upon heat-treatment of the microspheres and holds its shape after cooling, e.g., a thermoplastic.

Such a sheath can be applied by extrusion, as shown in FIG. 3, or, as illustrated in FIG. 2, by passing the coated central member 20 though a second bath 28 of a heated, molten thermoplastic. A sheath is thus provided on the coated central member, which stabilizes it and provides a uniform outer surface to the formed precursor 30. This can be accomplished simply by pulling the coated central member 20 over a series of rollers 22-25. The central member, having been sheathed in the thermoplastic, may be drawn through a sizing or roller die 32 to ensure a smooth outer surface, useful in further processing and use. The sheathed member may be cooled in air, in a water bath 34, or by a water spray, before being spooled at 36.

Alternatively, the sheath can be provided by extrusion, that is, by forcing molten sheath material into a die as the coated central member is drawn through the die. FIG. 3 shows an exemplary process in schematic form. The extrusion process to be employed is essentially similar to that used to apply thermoplastic insulation to electrical wiring. Pellets 40 of the desired sheathing material are disposed in a hopper 42. A screw, rotated as indicated by arrow 44*a*, drives the pellets along a tube 46. The tube is heated as indicated at 48, so that the pellets are melted as they move along the tube 46. The molten thermoplastic is then forced into a die assembly 50, and forced into intimate contact with the coated central member 20. The sheathed central member 52 can again be cooled by a water spray 54 or bath as it exits the die assembly 50, before being spooled at 56. The details of this and other suitable extrusion processes, e.g., crosshead extrusion, are well known to the art.

The thermoplastic used as the material of the sheath may be any of a wide variety of materials well known to the art; for example, the Berbond material, polypropylene, polyethylene, elastomer polyester, polyvinyl chloride, polyurethane, acrylics, polycarbonate, and various hot melt adhesives might all be usefully tried. The art will recognize that this list could be expanded greatly. Experimentation to determine the optimal materials, thicknesses, and the like for particular applications is within the skill of the art. In initial testing, polyurethane PU-2102-90 and polypropylene 3622 materials were tried. The polyurethane material provided greater expansion but was sticky, which feature might be of use in certain applications, while the polypropylene expanded somewhat less but had a dry surface after cooling. Plural sheaths of differing materials applied in various ways, such as coextrusion of different sheathing materials, might also be useful.

In a further alternative, an effective sheath might be applied by weaving, i.e., application of multifilamentary yarns over the central member having been coated by the layer comprising microspheres.

The resulting "precursor" 30 can then be used in producing a wide variety of possible products and then heat treated to be expanded substantially uniformly along its length, altering the properties of the product in numerous useful ways.

The specifics of a successful test were as follows:

A 1000 denier polyester yarn was employed as the filamentary central member. The binder used was the Berbond material identified above, with 25% by weight of Expancel 95DU-120 microspheres added. Tests were run with polyurethane PU-2102-90 and polypropylene 3622 materials applied as the sheath, by extrusion. The heat treatment involved exposure to 410 F to 425 F for 2 min.

The nominal average diameter of the central member was 14 mils before coating, and 24 mils after coating by a microsphere layer 5 mils thick. In one test, a PU-2102-90 polyurethane sheath approximately 5.5 mils thick was applied, so the precursor was 36 mils in diameter overall. This yarn expanded to approximately 59 mils in diameter after heat treatment, yielding an expansion ratio of approximately 64%.

Of course, the invention is not to be limited to these exemplary values.

Such yarns could be used as stuffer yarns in weaving of dryer felts alone or in combination with other materials in either or both the transverse and machine directions, that is, in both warp and weft. A typical choice for the central yarn would be 1000 denier multifilamentary polyester, approximately 14 mils in diameter. A layer of the expansible microspheres on the order of 5 mils thick would be added, and a thermoplastic sheath on the order of 8 mils thick would be added, for an overall diameter of the coated, sheathed yarn of 40 mils. Expansion to on the order of 60-70 mils would be expected upon heat treatment. As noted above, the step of coating the yarn with the microspheres could be repeated, to build up the thickness of the layer and thus increase the overall expansion of the precursor under heat treatment. As also mentioned above, plural sheathing layers might also be employed.

A flat polyester ribbon 2.53 mm wide×0.53 mm thick was also successfully coated with microspheres in the same manner. Due to equipment limitations this could not be sheathed. Nonetheless, this configuration shows promise as a stuffer yarn. This ribbon-like central member would be coated with microspheres and sheathed so as to expand to between about 3×0.6 and 3.5×0.7 mm after expansion, that is, for an expansion ratio of between 20 and 40%.

A relatively heavy thread for sewing materials together, e.g. for shoemaking, made according to the invention might employ a so-called 420 denier/3 ply/2 ply polyester central member, i.e., totaling 2520 denier overall, which would be about 22 mils in diameter. This could be given a 4-5 mil layer of the microspheres in a binder, and sheathed in 5-6 mils of thermoplastic, for an overall diameter of 40-45 mils before heat treatment; heat treatment would cause this thread precursor to expand to on the order of 75 mils, sealing any apertures made in sewing and securing the materials together firmly. Garment threads would typically employ a much lighter central member, of on the order of 250-750 denier.

In addition to the preferred binder materials used to coat the central member with microspheres as discussed above, others perhaps usefully tried would include low melting point hot melt adhesives, urethane, and aqueous-based acrylics. As mentioned, alternatives for the sheath include various thermoplastics such as polyurethane, polyester, and polycarbonate. As indicated, the choice of the resin material chosen for the sheath influences the overall size of the finished product. Materials having a melt flow index, referring to the ASTM D1238 or ISO 1133 test procedures, of approximately 10-15 at 190 C and 2.16 kg are currently preferred, but materials of higher melt flow index values, possibly as high as 30, may be useful.

Alternative types of microspheres that might be usefully tried include Expancel 92 DU 120, Expancel MB, and Expancel 93 DU 120. The best processing conditions for each possible embodiment will of course vary in accordance with the specific combination of materials chosen.

Figure 4:
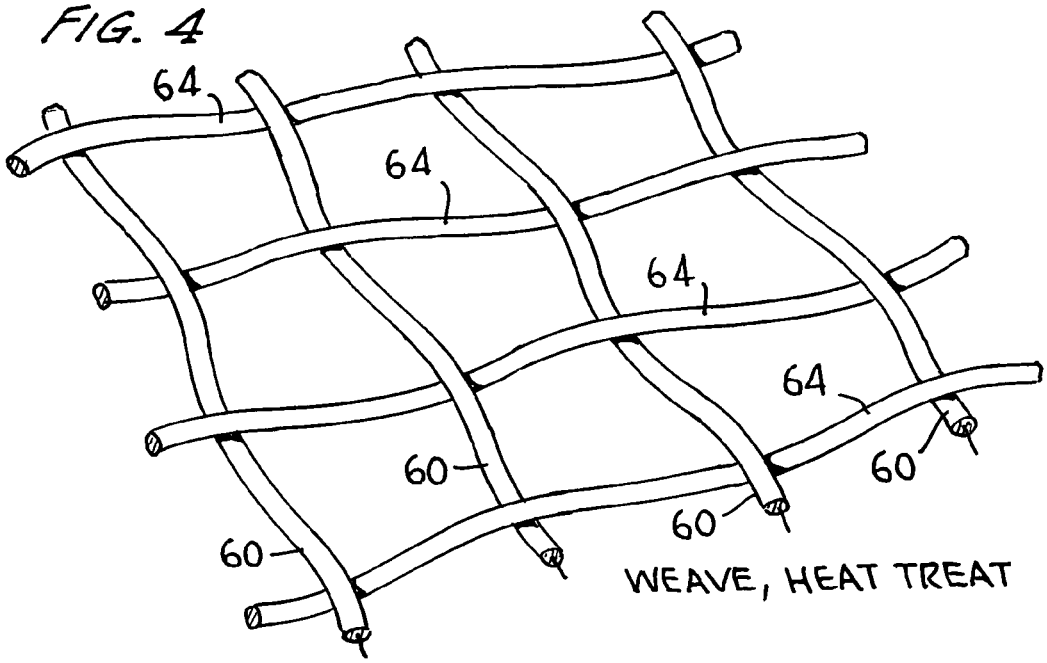
FIG. 4 shows schematically a fabric woven using the precursor yarn, which is then heat-treated, yielding the product of FIG. 5, which shows schematically the product having been heat-treated, illustrating the change in porosity effected by expansion of the yarns made according to the invention.
Figure 5:
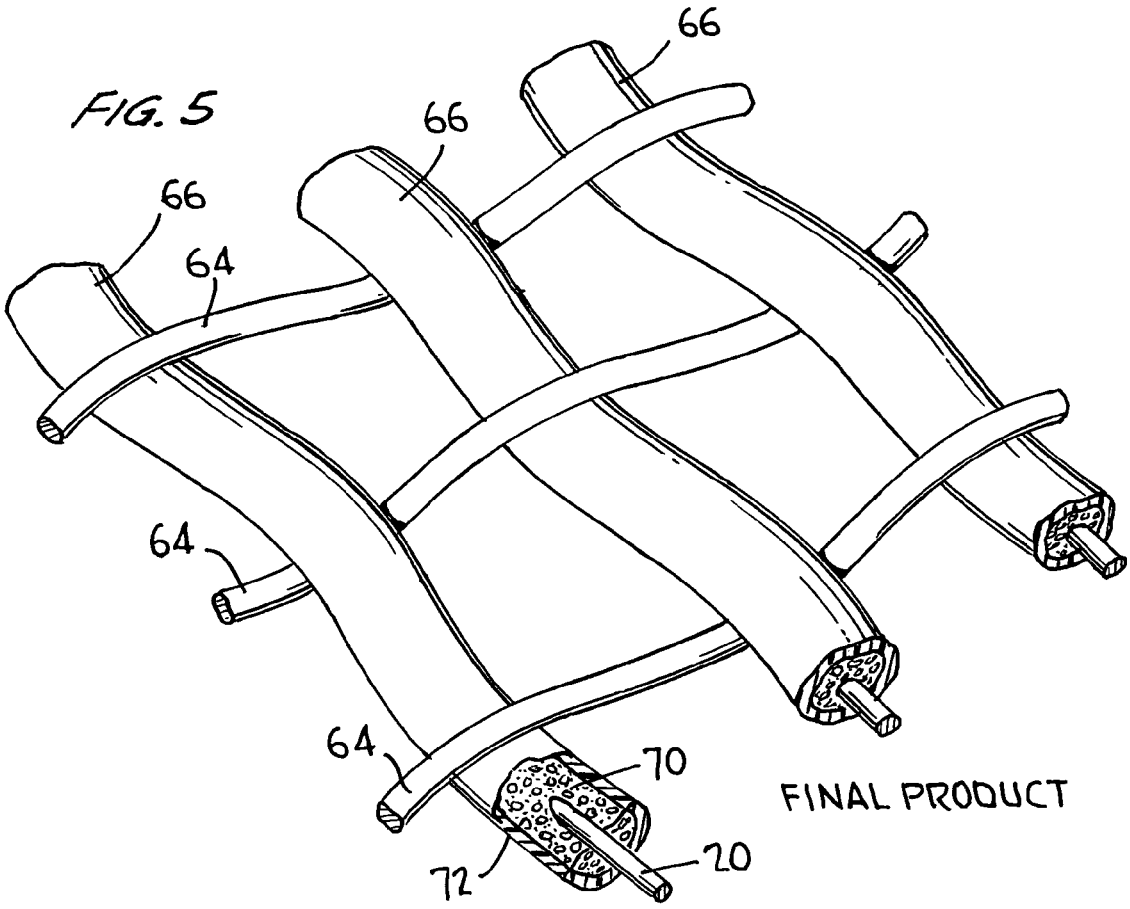

FIGS. 4 and 5 show respectively "before" and "after" schematic drawings of a fabric, such as a papermaker's felt, made in this embodiment by weaving the expansible yarn precursor 60, produced as above, in one direction, with conventional yarns 64 used in the other direction. Of course the invention is not thus limited. As illustrated in FIG. 4, the yarns are woven prior to expansion; after weaving, a heat treatment as above is performed, resulting in the structure of FIG. 5, in which the precursor yarns have expanded as indicated at 66, referred to as post-treatment yarns. As illustrated, a substantially tubular mass 70 of the expanded microspheres surrounds the filamentary central member 20, spacing it from the sheath 72. It will be apparent that the relative porosity of the fabric in FIG. 5 is reduced with respect to the FIG. 4 fabric, and that additional reduction in porosity could be achieved by using the expansible yarns of the invention in both directions, as both warp and weft. Further, it will be apparent that it will normally be much easier to weave the fabric using the unexpanded yarn precursor 60 of FIG. 4 than it would be to do so using the much larger post-treatment yarns 66 of FIG. 5.

Thus the steps in using the precursor yarn 60 of the invention in manufacturing a fabric such as a papermaker's yarn are simply to weave it using the unexpanded yarns as all or part of the yarns used in either or both the warp and weft, heat treat it to cause the yarns to expand, and use the felt as usual. It will be appreciated that additional control of porosity and other properties of the fabric could be further controlled by weaving a multiple-layer fabric, by using various proportions of the precursor yarn in weaving of the product.

As mentioned above, a number of applications for threads made according to the invention will be apparent to those of skill in the art. One such class of applications is as sewing thread used to fabricate various products of leather or fabric, where the ultimate product is to be water- and/or air-impermeable, such as sails, outer garments, tents, awnings, shoes, and the like. Such products are punctured by many small holes in the sewing process, many of which will doubtless leak. If a thread according to the invention is used to fabricate such products, and is then heat treated to cause it to expand, the holes will be neatly and permanently sealed, and the components of the product permanently secured to one another.

Another use for the thread of the invention would be as an thread for decorative embroidery, with the color of the material of the sheath corresponding to the desired color of the embroidery pattern. The thread could easily be applied in its unexpanded state, using any of the customary embroidery techniques and equipment, and then heat treated to expand it, perhaps in a hot press as used to imprint designs on clothing. As the yarn expanded it would tend to form a very solid, intensely colored design. The expansible filamentary precursors would be similarly suitable as decorative surface, woven, or knit yarns.

Another use for the expansible yarns of the invention would be in manufacture of rigid composite members, such as shaped panels for aircraft fuselages, vehicle bodies, and boat hulls, elongated tubular and shaped members for various structural uses, and the like. In a simplified example, shaped panels are now commonly made by disposing a first layer (or several layers) of fabric, such as fiberglass, aramids, or carbon fiber in a mold, placing a lightweight foam or wood core over the fabric, and then adding second or additional layers of fabric. The whole is then infused with a hardening resin, such as polyester, vinylester, or epoxy; pressure is applied by compressing the assembly in a two-part mold, by vacuum-bagging, or the like. The resin saturates the fabrics, and, after hardening, secures the fibers in the desired positions. The fibers provide tensile strength to the assembly. The presence of the core spaces the two fabric layers, in particular the high-strength fiber from which they are woven from one another; this gives the panel substantial additional resistance to deformation while adding minimal weight.

Figure 6:
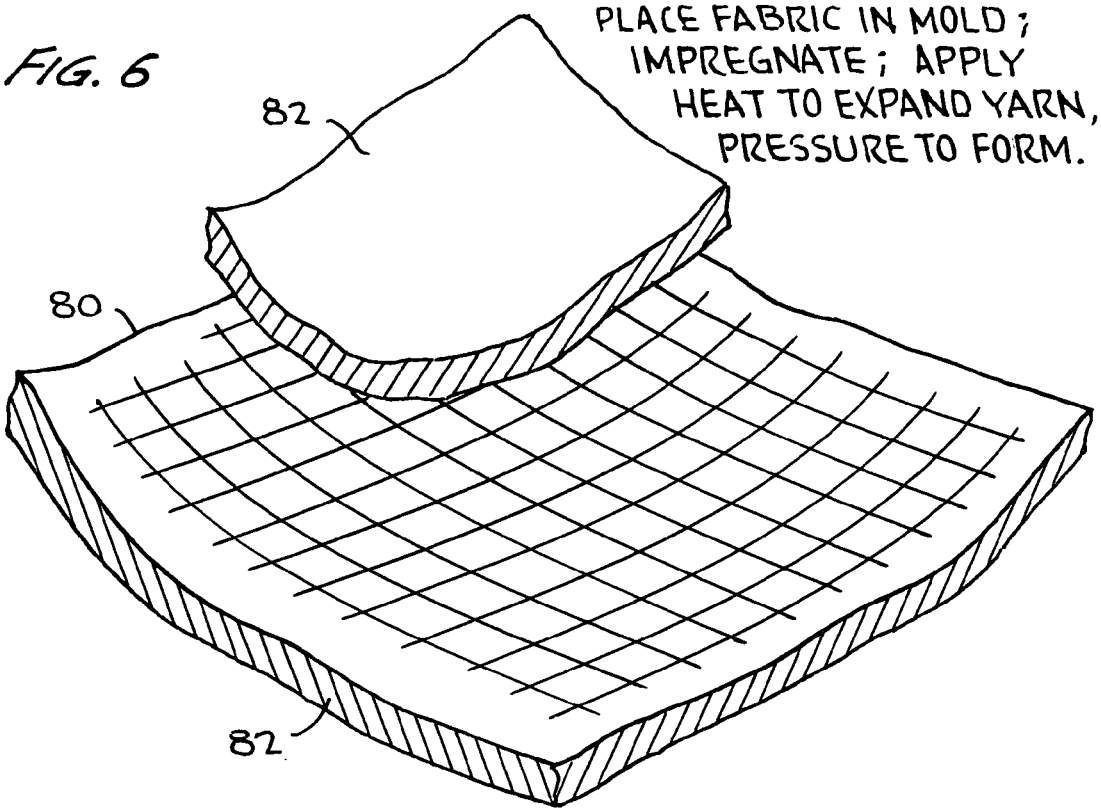
FIG. 6 shows schematically the formation of a solid product employing the yarns of the invention.
Figure 7:
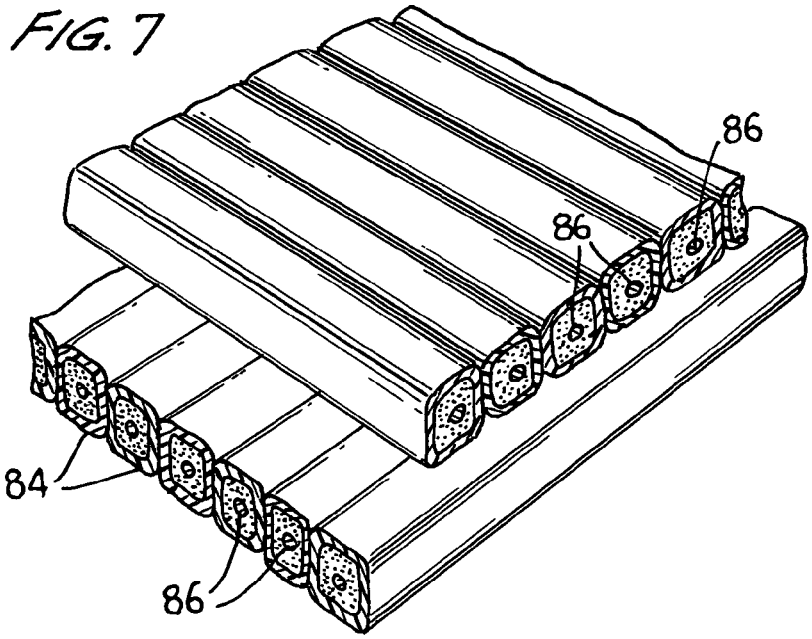
FIG. 7 shows a cross-sectional view of such a product.

According to this aspect of the invention, high-strength fibers can be spaced over the cross-section of a composite panel by placing fabrics (either woven or non-woven) of the expansible yarns of the invention in a mold, and similarly infusing them with a hardening resin while applying heat, to cause the microspheres to expand. See FIG. 6, in which a fabric 80 woven of the yarns of the invention is depicted laid in one half 82 of a mold. The fabric 80 would be infused with a suitable resin (the material of the sheath being selected to bond securely to the resin), the fabric heated to cause the microspheres to expand, and a mating mold half applied (or, for example, vacuum bag techniques employed) to apply pressure to the other face of the fabric, ensuring that the panel thus manufactured takes the proper formation. Various high-modulus central members, e.g. of multifilamentary carbon fiber or fiberglass, could be used to maximize the strength of the component. As the microspheres expand the yarns will be forced to fill the mold tightly, conforming to one another, as shown at 84 in FIG. 7. Excess resin will be forced out of the mold, reducing the weight of the overall assembly, while the central members 86 will be effectively dispersed throughout the cross-section of the panel; this will yield a much stiffer structure than one in which the same quantity of central members were simply laid in a mold and infused with a resin. Further, the microspheres, being essentially hollow, add little weight to the assembly. This could be a very cost-effective way of forming such components, since the fabric can be manufactured in bulk and simply draped in the mold, eliminating many steps with respect to the present process.

The yarns of the invention could be used to make shaped structural members, e.g., I-beams or tubular members, with the high-modulus central fibers spaced throughout the cross-section of the component, effectively being spaced from one another by the layers of microspheres and sheathing material, yielding a strong and lightweight member with the expensive strengthening central fibers used to great efficiency in a simple process. Tubular members could be made by braiding the expansible yarns of the invention into tubular form and heating the assembly in a heated die, expanding the microspheres, while forcing a hardening resin around the yarns, to secure them in place. Beams and the like could be made simply by "pultruding" a large number of the yarns through a hot die while saturating them with a hardening resin. The yarns of the invention are similarly amenable to filament winding and like processes, modified in each case to include the step of heating the yarns to cause the microspheres to expand.

Other uses and advantages of the expandable yarns and threads will occur to those of skill in the art and are deemed to be within the scope of the invention. Therefore, while preferred embodiments of the invention have been described herein, these are not to be taken to limit the invention, but merely as exemplary thereof.

What is claimed is:

1. A method for producing and using an expansible filamentary sheathed precursor, comprising the steps of:

passing a multifilamentary central member through a first bath comprising a quantity of heat-expansible microspheres in a liquid binder, such that the liquid binder penetrates between the filaments of the central member, such that the surface of said multifilamentary central member is coated by said heat-expansible microspheres, and such that the microspheres do not substantially penetrate between the filaments of the multifilamentary central member;

applying a sheath of thermoplastic material to the coated central member, by:

passing said multifilamentary central member coated by said heat-expansible microspheres through a quantity of a desired thermoplastic material having been heated to a temperature above the activation temperature of the microspheres so as to be melted, and immediately cooling the surface of the thermoplastic material, such that molten thermoplastic material is solidified over the coating of heat-expansible microspheres on the central member without expansion of the heat-expansible microspheres, thus forming an expansible sheathed precursor comprising a multifilamentary central member with a coating of expansible microspheres on the surface thereof, sheathed by the thermoplastic material;

employing the expansible sheathed precursor in fabrication of a product; and exposing the fabricated product to heat, causing the sheath of thermoplastic material to soften and the expansible microspheres to expand, such that the expansible sheathed precursor expands, modifying the properties of the fabricated product in a desired manner.

2. The method of claim 1, wherein the step of employing the sheathed precursor in manufacture of a product comprises the step of weaving a fabric using the sheathed precursor at least in part as the yarn used in weaving, whereby the porosity of the fabric is modified upon exposure to heat.

3. The method of claim 1, wherein the step of employing the sheathed precursor in manufacture of a product comprises the step of employing the sheathed precursor as a thread employed in sewing a product together, whereby punctures formed upon sewing are sealed by expansion of the sheathed precursor upon exposure of the sewn product to heat.

4. The method of claim 1, wherein the step of employing the sheathed precursor in manufacture of a product comprises the step of using the sheathed precursor as an decorative surface, woven, knit or embroidery yarn.

5. The method of claim 1, wherein the step of employing the sheathed precursor in manufacture of a product comprises the step of coating the precursor yarns with a hardening resin and heating the yarns to cause the microspheres to expand while confined to a desired shape, so that the expanded yarns are secured in the desired position by the hardened resin.

6. The method of claim 5, wherein the yarns having been coated with a hardening resin are confined to a desired shape during heating of the yarns and hardening of the resin by being wound over a mandrel, such that a product of desired cross-sectional shape is formed after the microspheres have expanded and the resin hardened.

7. The method of claim 5, wherein the yarns having been coated with a hardening resin are confined to a desired shape during heating of the yarns and hardening of the resin by confined in a mold, such that a product of desired cross-sectional shape is formed after the microspheres have expanded and the resin hardened.

8. The method of claim 1 wherein the sheath of thermoplastic material is applied to the coated central member by passing the coated central member through a bath of molten thermoplastic material.

9. The method of claim 1 wherein the sheath of thermoplastic material is applied to the coated central member by extruding the thermoplastic material over the coated central member.

10. The method of claim 1, wherein the thermoplastic material of said sheath is selected from the group consisting of PVC, polyurethane, polyester, acrylics, polycarbonate, polypropylene, and polyethylene.

11. The method of claim 1, wherein said multifilamentary central member is selected from the group comprising spun and filamentary yarns, threads, ribbons, wires, and tows, of both metallic and non-metallic materials.

12. The method of claim 1, wherein the microspheres are adhered to the filamentary central member using a binder selected from the group consisting of low-temperature hot-melt adhesives, aqueous urethane, and acrylics.

13. The method of claim 1, wherein the microspheres are hard shelled generally spherical members formed of thermoplastic material filled with a material that expands substantially when heated to a transition temperature.

* * * * *